US006968742B2

(12) United States Patent
Rodenhauser et al.

(10) Patent No.: US 6,968,742 B2
(45) Date of Patent: Nov. 29, 2005

(54) CONTROL BOX

(75) Inventors: Helmut Rodenhauser, Ober-Ramstadt (DE); Jürgen Tschirschke, Hettenleidelheim (DE)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/870,835

(22) Filed: Jun. 17, 2004

(65) Prior Publication Data

US 2005/0011269 A1 Jan. 20, 2005

(30) Foreign Application Priority Data

Jun. 25, 2003 (EP) ..... 03013473

(51) Int. Cl.[7] ..... G01L 7/00

(52) U.S. Cl. ..... 73/706

(58) Field of Search ..... 73/706, 714, 715–727, 73/756; 17/383, 384, 262; 261/19–37

(56) References Cited

U.S. PATENT DOCUMENTS 4,028,441 A * 6/1977 Richards ..... 261/36.1
4,052,969 A * 10/1977 Ando et al.
4,148,334 A * 4/1979 Richards ..... 137/389
4,484,445 A * 11/1984 Gillbrand
4,683,863 A * 8/1987 Sugiura
4,727,848 A * 3/1988 Stumpp et al.
4,741,163 A * 5/1988 Hidaka et al. ..... 60/602
5,333,456 A * 8/1994 Bollinger

* cited by examiner

*Primary Examiner*—William Oen
(74) *Attorney, Agent, or Firm*—Pendorf & Cutliff; Greg Dziegielewski

(57) ABSTRACT

A control box for use, for example, to open and close a bypass valve (18, 19) of a turbocharger, in which the closing movement occurs with higher force than the opening movement, wherein the closing movement occurs in the direction of a spring force and the opening movement in the direction against said spring force. The control box comprises two pressure chambers (4, 6) and both pressure chambers may be set to either atmospheric pressure or negative pressure.

6 Claims, 5 Drawing Sheets

CONTROL BOX

FIELD OF THE INVENTION

The present invention relates to a control box.

BACKGROUND OF THE INVENTION

Control boxes are employed typically in the automotive area in order to transform a control signal into a mechanical movement and convey it to a part that needs to be controlled.

As an example, such control boxes are used for turbochargers, where they open and close a valve plate of an exhaust gas bypass in accordance with the requirements pertaining to a particular driving situation.

In this area of use, the requirements have been modified according to particular characteristics over time, in line with progress in automobile technology.

This evolution may be described approximately as follows:

A positive pressure—control box comprises, as shown in FIG. 1, an upper chamber 4 and a lower chamber 6 which are separated from each other by a membrane 12 in gas-tight manner. The upper chamber 4 includes a control duct 10 through which the upper chamber may either be set at atmospheric pressure (At) or at positive pressure up to a maximum pressure ($P_{max}$). The pressure set at any moment may therefore vary between At and $P_{max}$.

The lower chamber 6, which is open at 8, is continuously held at atmospheric pressure At. A helical spring 3 is arranged in the lower chamber 6 in a manner so as to solicit the membrane upwards.

The membrane 12 is connected to a rod 14 in a manner so as to be axially pulled or pushed by the membrane during its movement in the direction of movement (upwards or downwards) of the membrane.

If atmospheric pressure prevails in the upper chamber, the same pressure prevails on both sides of the membrane, and spring 3 pushes the membrane upwards and rod 14 is pulled upwards as well.

As illustrated schematically, this movement of rod 14 produces a lowering of valve plate 18 onto valve seat 19, thus closing the valve.

The force of spring 3 is chosen to be relatively high, because for the use of such a positive pressure control box for the closing of the by-pass valve a relative high force is needed, because the by-pass is subject to relatively high pressure, built up be the exhaust gases expelled from a combustion engine.

This type of pressure box has the disadvantage that it uses positive pressure, whereby the positive pressure has to be produced on demand, which creates a time lag.

Therefore, in the automobile technology one has shifted more to negative pressure—control boxes, since negative pressure is available from other components in the engine space of the vehicle.

A typical traditional negative pressure box is illustrated in FIG. 2.

The negative pressure—box in FIG. 2 includes also an upper chamber 4*a* and a lower chamber 6*a* which are separated from each other by a membrane 12*a* in gas tight manner.

A control duct 10*a* is susceptible to be connected to a non-illustrated negative pressure source. The lower chamber is open and is continuously held at atmospheric pressure.

In this control box, the spring is positioned in the upper chamber, so that, if atmospheric pressure prevails on both sides of the membrane 12*a*, spring 3*a*, membrane 12*a* and rod 14*a* are pushed downwards, so as to open valve 18, 19.

If the upper chamber is set to negative pressure, the atmospheric pressure in the lower chamber pushes the membrane upwards against the force of the spring and closes valve 18, 19. The force which is required to close the valve, is produced by the negative pressure in the upper chamber from which one needs to deduct the force of the spring.

This means, that for relative high closing forces, the surface of the membrane needs to be relatively large in order to translate the relatively small pressure difference between the strongest negative pressure and atmospheric pressure into a sufficiently high force.

A large membrane surface, however, requires an increase of the dimensions of the control box, which is disadvantageous for obvious reasons.

In order to overcome this disadvantage, the present inventors have invented another system, termed herein a bi-pressure control box.

FIG. 3 illustrates the principle of a bi-pressure control box. Upper chamber 4*b* and lower chamber 6*b* are again separated by a membrane 12*b* in gas tight manner. The upper chamber 4*b* includes a control duct 10*b* for the setting of a negative pressure in the upper chamber and the lower chamber has a control duct 20 for the setting of a positive pressure in the lower chamber.

Lower chamber 6*b* is closed by a sealing 22 which permits axial movement of rod 14*b*. Primarily, this control box acts in the same way as the control box of FIG. 2, but provides the further possibility to increase the closing force of the rod 14*b* by applying a positive pressure to the lower chamber 6*b*, because the force of the rod is the product of the membrane surface and of the pressure difference of at maximum Pmax—V (V=vacuum), minus the force of the spring. Due to the additional positive pressure-connection of the control box of FIG. 3, as compared to the control box of FIG. 2, the pressure component of the pressure difference between the chambers is increased.

The bi-pressure control box of FIG. 3 combines the advantage of the control box of FIG. 1 (high closing force due to strong spring) with the advantage of the control box of FIG. 2 (use of negative pressure) but loses a portion of this advantage, however, through the use of additional positive pressure.

It is therefore the object of the present invention to devise a control box which combines all partial advantages of the different states of the art, without increasing the size, while working with negative pressure only and whereby nevertheless a high closing force is obtained.

This object is achieved by a control box according to the claims herein.

BRIEF DESCRIPTION OF THE DRAWINGS

The invention will now be explained in detail with reference to the drawings, wherein.

DETAILED DESCRIPTION

Building on the state of the art as illustrated in FIG. 1 through FIG. 3, FIG. 4 illustrates the principle of a control box according to the present invention.

Again, the control box is separated by a membrane 3*c* into an upper chamber 4*c* and a lower chamber 6*c* in gas tight manner. The lower chamber includes a spring 3*c* and upper chamber as well as lower chamber include control ducts 10*c*, 22*c* leading to a negative pressure source.

The upper chamber may either be set to atmospheric pressure At or to negative pressure, and the lower chamber likewise.

Should the valve 18, 19 be closed with high force, a high force of spring 3*c* is required. The force of spring 3 may be chosen relatively high, and it will even be increased by the negative pressure in the upper chamber while, in FIG. 1, the atmospheric pressure in the upper chamber, set as minimal pressure in order to close the valve, does not contribute to increase the closing force of the rod.

In the opposite case, in order to open the valve, rod 14*c* must be pushed downwards whereas the negative pressure in the lower chamber must suffice to just (or not even) overcome the force of the spring by a little amount, because the valve 18, 19 in a turbo charger are easy to open because of the pressure prevailing in the by-pass.

Figure 1:
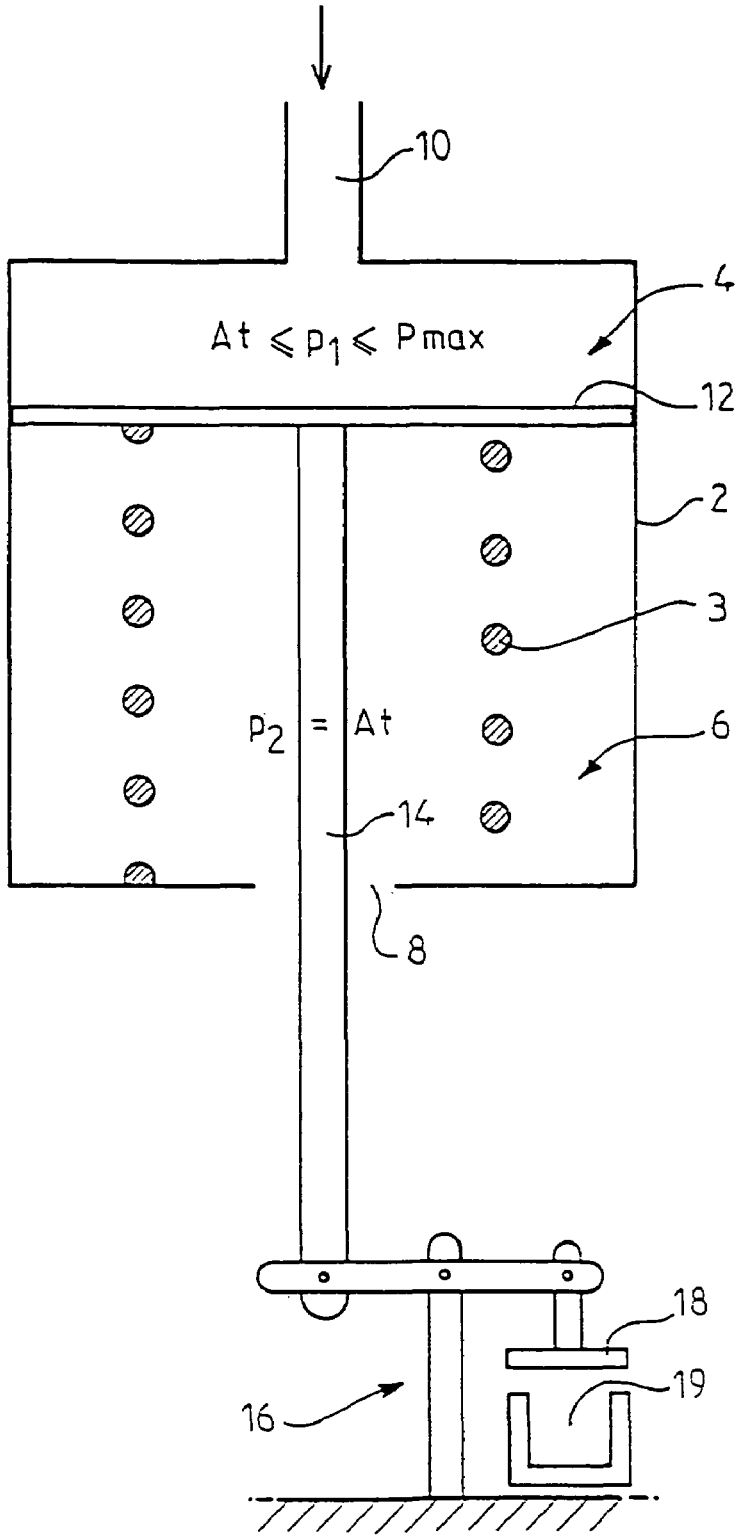
FIG. 1 to FIG. 3 illustrate control boxes according to the state of the art.
Figure 2:
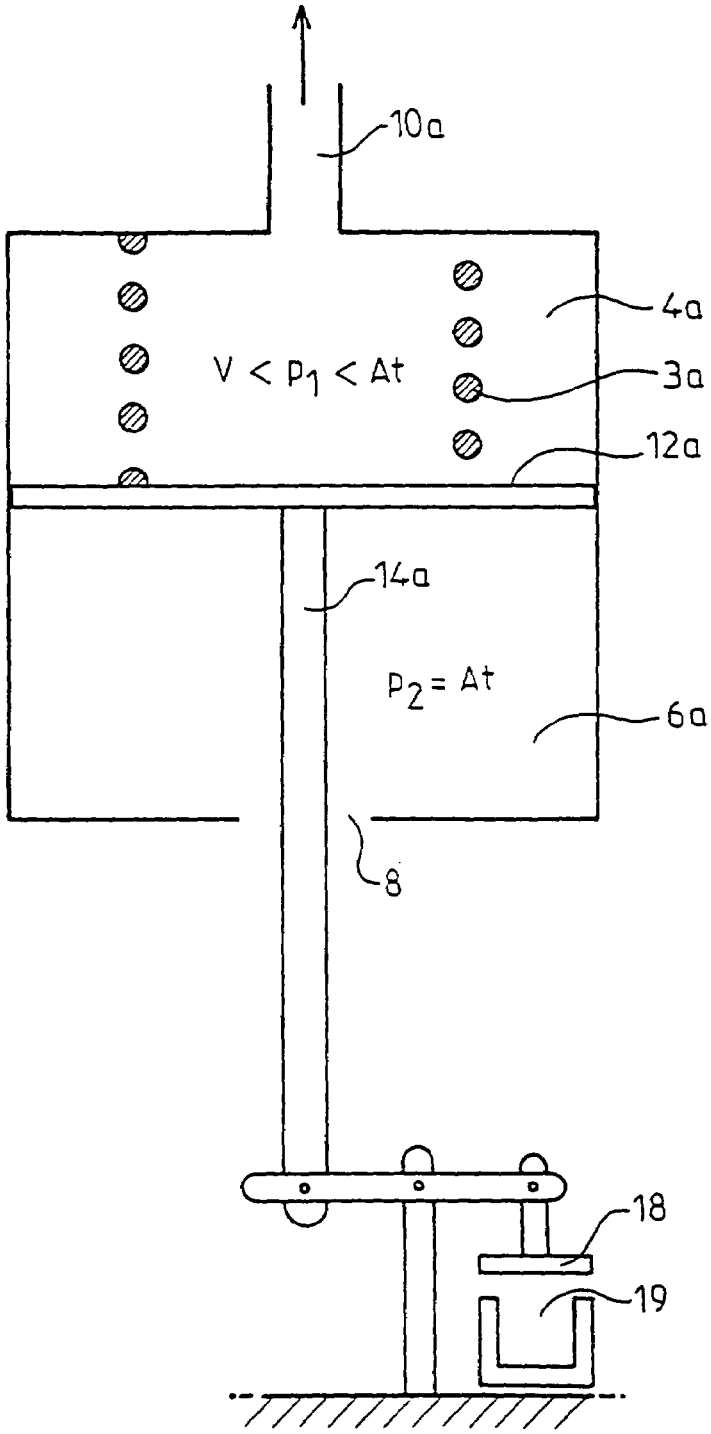
Figure 3:
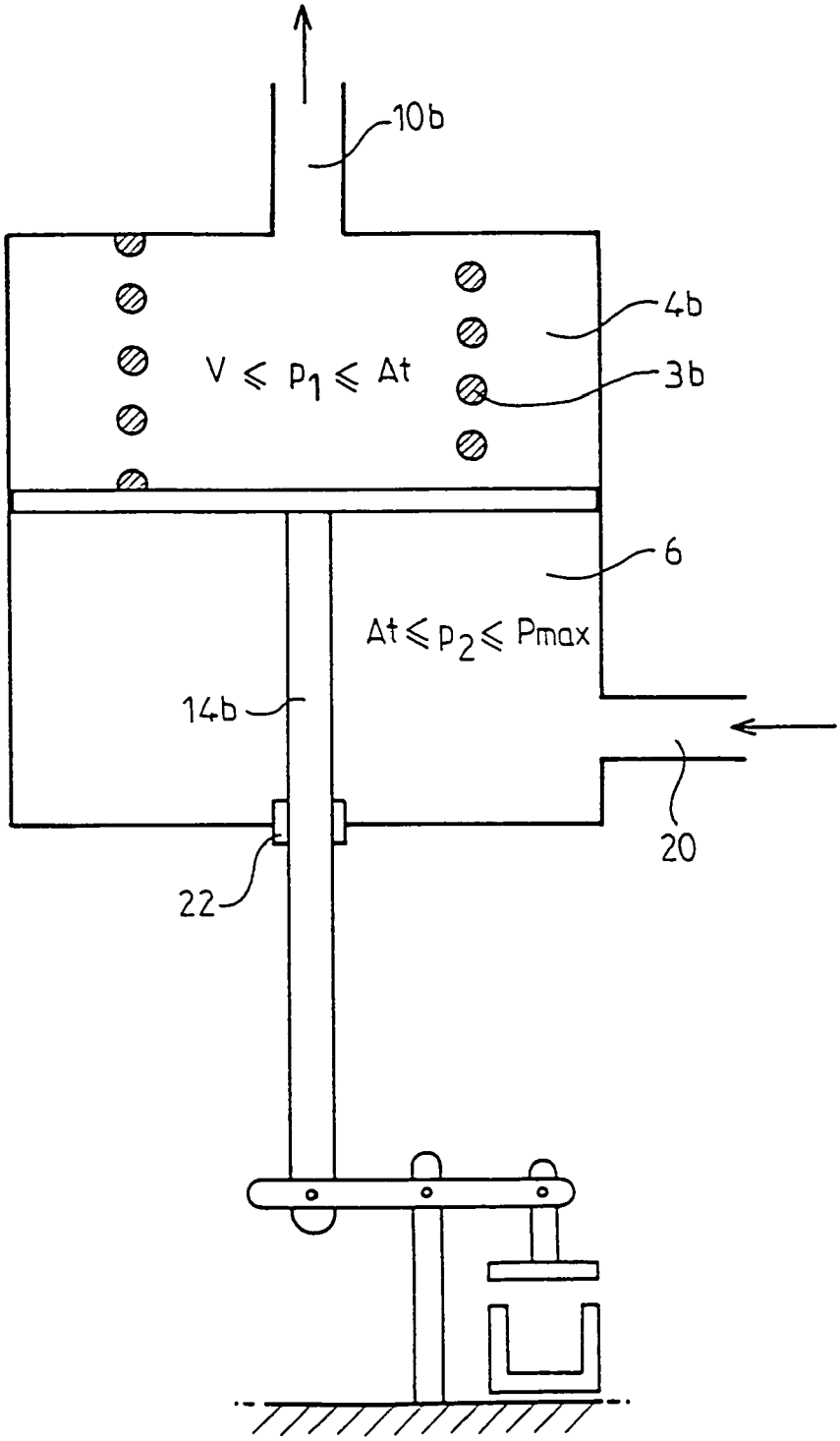

The comparison with control boxes of the state of the art reveals that the control box of the present invention offers the advantage to require no positive pressure such as is the case for control boxes according to FIGS. 1 and 3 and compared to the control box of FIG. 2 it provides the advantage to employ the force of the spring in direction of closing the valve, so that one can use a strong spring such as in FIG. 1, whereas the control box of FIG. 2 obtains the closing force only from the negative pressure and moreover, after subtraction of the spring force.

Figure 5:
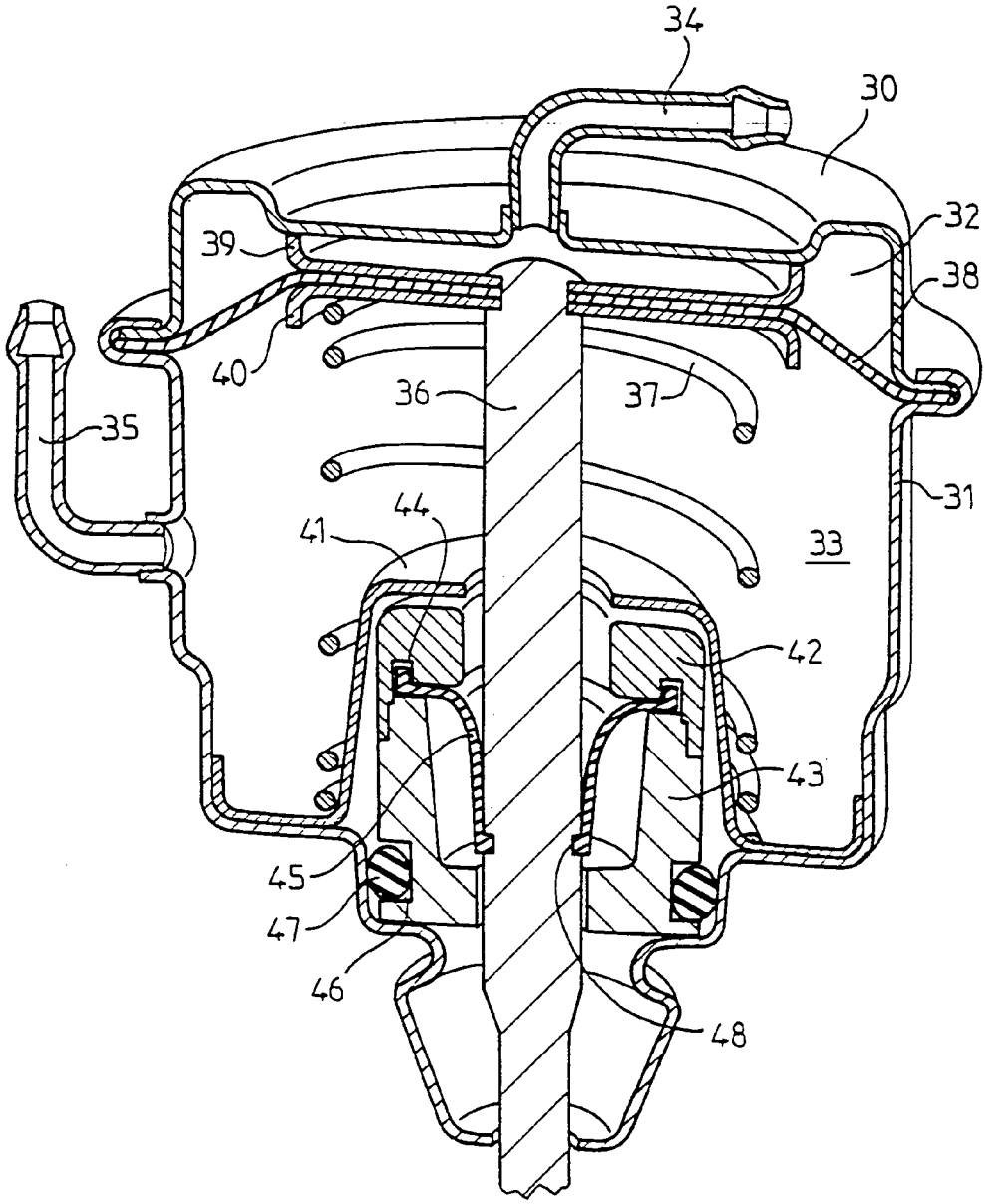
FIG. 5 is a real view of a control box according to the present invention.

FIG. 5 illustrates a real embodiment of a control box according to the present invention, wherein the control box is formed by an upper housing 30 and a lower housing 31.

Upper and lower chambers are fastened to each other by a flanging technique and the edges of both housings clamp between them a membrane 38 so that the membrane divides the control box into an upper chamber 32 and a lower chamber 33.

Figure 4:
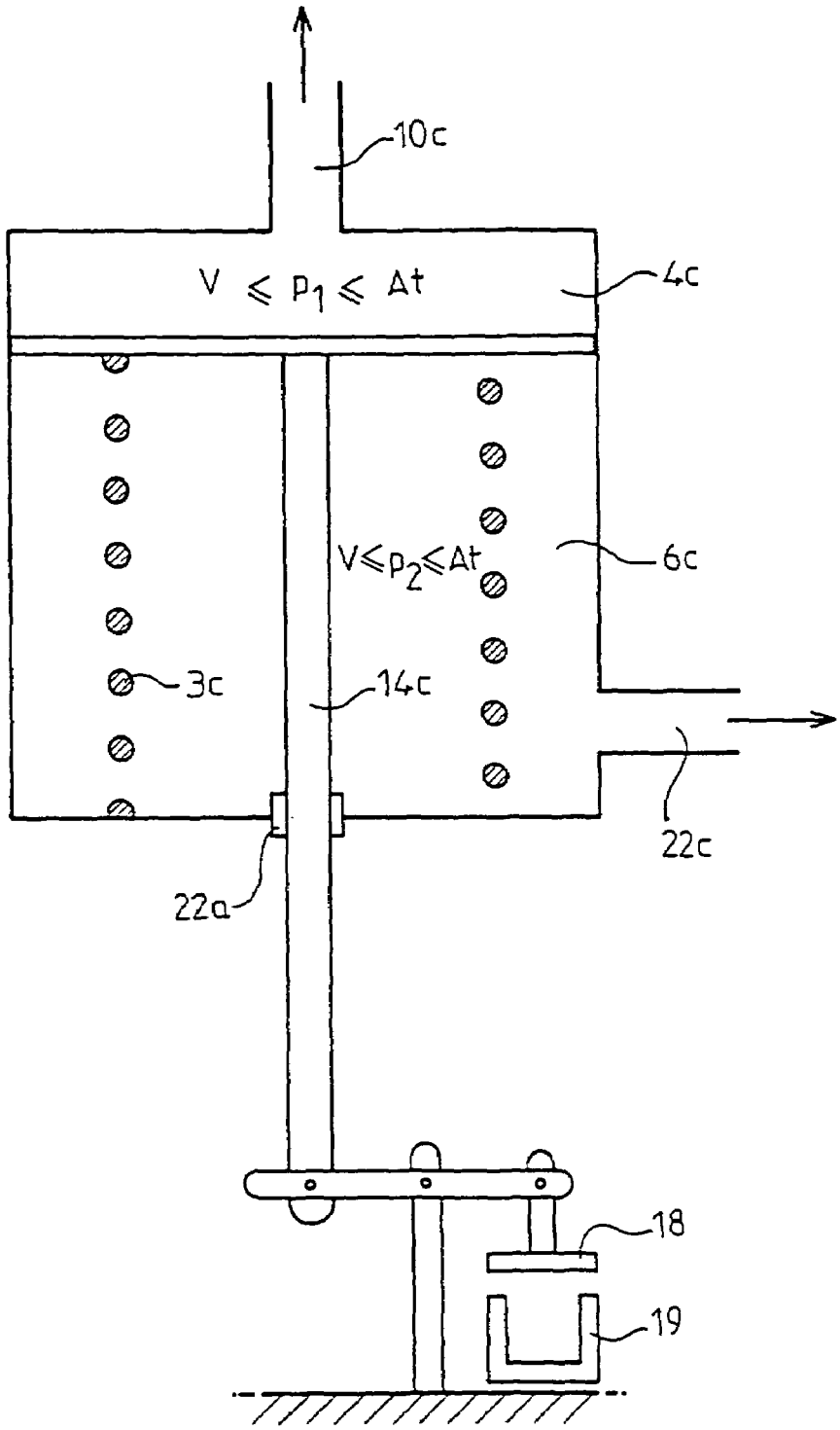
FIG. 4 is a schematic view of a control box according to the invention.

As was explained with reference to FIG. 4, upper chamber 32 may be set on any pressure between atmospheric pressure and strongest available negative pressure by suction duct 34 and likewise lower chamber 33 by means of suction duct 35.

Membrane 38 is held in exactly radial configuration by two plate elements 39, 40 and if the pressure is varied in either one of the chambers, the membrane is shifted, according to the new pressure conditions in the one or the other directions and pulls or pushes control rod 36 with it, so that a controlled pressure variation in either one or in both of the chambers results in a targeted axial movement of the control rod.

Helical spring 37 is arranged such that it pre-solicits the membrane in the direction of a decrease of the volume of the upper pressure chamber.

At the lower end of the lower pressure chamber, the lower housing is provided with an upside-down oriented pot 41 which simultaneously serves as foot for the helical spring and as housing of a sealing arrangement.

The sealing arrangement comprises two support elements 42 and 43, which snugly fit around one end of a conical sealing 45 positioned in a recess 44, the other end of this sealing 45 engaging, in sealing manner, into a ring groove 48 of the control rod by means of its own elastic force.

Moreover, the lower support element 43 comprises a recess 46 which houses an O-ring seal 47 by which the lower pressure chamber is sealed against the environment in the same manner as by seal 45.

The described arrangement of the different seals results in a reliable sealing of the lower pressure chamber while keeping the control rod movable.

The invention has been described in detail on the basis of an exemplary embodiment, it being understood, that modifications may be made according to the particular use of a control box in order to adapt to particular requirements without departing from the spirit of the invention.

What is claimed is:

1. A control box for transformation of a control signal into a mechanical movement and for conveying said mechanical movement to a component to be controlled, said control box comprising a first pressure chamber (4), a second pressure chamber (6), a membrane (12) that separates said two pressure chambers from each other in a gas tight manner, a spring that pre-tensions said membrane in a first direction and a control rod which may be caused by said membrane (12) to execute control movements, at least one of said two pressure chambers (4, 6) being susceptible to be subjected to a change of pressure, thereby causing a control movement of said control rod, wherein said first pressure chamber (4) and said second pressure chamber (6) are connectable to one or several negative pressure sources via pressure ducts (10*c*, 22*c*), and wherein spring (3*c*) is located in the second pressure chamber.

2. The control box of claim 1, wherein the control rod (14) is capable of executing a first and a second type of control movement, wherein said first and second types of control movement are axially opposite to each other.

3. The control box of claim 2, wherein said first type of control movement is effectuated under the influence of a force which is higher than that of said second type of control movement.

4. The control box of claim 2, wherein the force communicated to the control rod (14) for execution of the first type of control movement of higher force corresponds to the force of the spring (3*c*) plus the force produced by the pressure difference between minimum pressure in the first pressure chamber and atmospheric pressure in the second pressure chamber.

5. The control box of claim 2, wherein the force communicated to the control rod (14) for execution of the second type of control movement of smaller force corresponds to the pressure difference between atmospheric pressure in the first pressure chamber and minimum pressure in the second pressure chamber, minus the force of the spring (3*c*).

6. The control box of claim 1, wherein said control rod (14) projects outside of the second pressure chamber (6) of the control box, whereas the opening (8), which is required therefor, of the second pressure chamber, is sealed against the environment such, that the control rod (14) may axially move while said second pressure chamber remains sealed.

* * * * *